US008561380B2

(12) United States Patent
Casto et al.

(10) Patent No.: US 8,561,380 B2
(45) Date of Patent: Oct. 22, 2013

(54) SYSTEM AND METHOD FOR CARD REPLACEMENT

(75) Inventors: Fred C Casto, Omaha, NE (US); Jon A Gates, Honey Creek, IA (US); Corey D Tunink, La Vista, NE (US)

(73) Assignee: First Data Corporation, Greenwood Village, CO (US)

( * ) Notice: Subject to any disclaimer, the term of this patent is extended or adjusted under 35 U.S.C. 154(b) by 486 days.

(21) Appl. No.: 12/403,994

(22) Filed: Mar. 13, 2009

(65) Prior Publication Data

US 2009/0235618 A1 Sep. 24, 2009

Related U.S. Application Data

(60) Provisional application No. 61/038,667, filed on Mar. 21, 2008.

(51) Int. Cl.
*B65B 5/06* (2006.01)

(52) U.S. Cl.
USPC ..... 53/473; 53/467; 53/460; 53/284.3; 53/244; 53/206; 493/216; 493/222; 493/919; 270/58.06

(58) Field of Classification Search
USPC ..... 53/486, 117, 206, 244, 255, 133.1, 460, 53/469, 473, 569, 170, 249, 284.3, 373.4, 53/377.6, 467, 171, 173; 493/216, 222, 493/919, 925; 270/58.06, 32
See application file for complete search history.

(56) References Cited

U.S. PATENT DOCUMENTS 1,558,305 A * 10/1925 Snape ..... 229/120.08
1,988,908 A * 1/1935 Mackinnon ..... 229/71
2,035,218 A * 3/1936 Bloom ..... 229/71
2,559,776 A * 7/1951 Larzelere ..... 229/92.1
2,941,711 A * 6/1960 Biek ..... 229/303
3,286,905 A * 11/1966 Farukhi ..... 229/122
3,370,781 A * 2/1968 Sroge ..... 229/71
3,656,684 A * 4/1972 Meehan ..... 229/92.8
3,774,839 A * 11/1973 Woods ..... 206/312
3,815,316 A * 6/1974 Brooke ..... 53/437

(Continued)

FOREIGN PATENT DOCUMENTS

EP 0534893 A1 3/1993
JP 08-230892 A 9/1996
JP 2001-341470 A 8/2006

OTHER PUBLICATIONS

U.S. Appl. No. 12/053,421, filed Mar. 21, 2008.

(Continued)

*Primary Examiner* — Hemant M Desai
*Assistant Examiner* — Gloria R Weeks
(74) *Attorney, Agent, or Firm* — Kilpatrick Townsend & Stockton LLP

(57) ABSTRACT

A system for assembling a shipping package includes a feeder feeding an envelope from a supply of envelopes and a transport mechanism that transports a shipping container from a supply of shipping containers and places the shipping container in position for the feeder to insert the envelope into the shipping container. The envelope contains a replacement presentation instrument and a shipping indicator, and the shipping indicator includes a shipping address visible through a first substantially clear window in the envelope. Each shipping container has a second substantially clear window, and when the envelope has been inserted into the shipping container, the shipping address is visible through the second substantially clear window.

21 Claims, 4 Drawing Sheets

(56) References Cited

U.S. PATENT DOCUMENTS

| | | | | | |
|---|---|---|---|---|---|
| 4,129,214 | A | * | 12/1978 | Gendron | 229/313 |
| 4,160,503 | A | * | 7/1979 | Ohlbach | 206/709 |
| 4,278,880 | A | * | 7/1981 | Buros | 235/493 |
| 4,294,400 | A | * | 10/1981 | Gendron | 229/67.3 |
| 4,499,705 | A | * | 2/1985 | Russell | 53/284.3 |
| 4,604,849 | A | * | 8/1986 | Zemke et al. | 53/284.3 |
| 4,763,789 | A | * | 8/1988 | Questel et al. | 206/454 |
| 4,807,805 | A | * | 2/1989 | Rutkowski | 229/69 |
| 4,815,654 | A | * | 3/1989 | Buescher | 229/305 |
| 4,843,802 | A | * | 7/1989 | Noll | 53/505 |
| 4,865,304 | A | * | 9/1989 | VanderSyde et al. | 270/58.06 |
| 4,922,689 | A | * | 5/1990 | Haas et al. | 53/569 |
| 4,930,977 | A | * | 6/1990 | Beeman et al. | 414/790.8 |
| 4,949,835 | A | * | 8/1990 | Beeman et al. | 198/464.4 |
| 5,031,382 | A | * | 7/1991 | Boyle | 53/411 |
| 5,125,214 | A | * | 6/1992 | Orsinger et al. | 53/460 |
| 5,169,061 | A | * | 12/1992 | Buescher | 229/305 |
| 5,197,260 | A | * | 3/1993 | Chevalier et al. | 53/461 |
| 5,232,087 | A | * | 8/1993 | Schluger | 206/45.29 |
| 5,232,248 | A | * | 8/1993 | Talbott | 283/81 |
| 5,233,812 | A | * | 8/1993 | Coppola | 53/411 |
| 5,277,307 | A | * | 1/1994 | Kelly | 206/772 |
| 5,353,931 | A | * | 10/1994 | Antik | 206/387.1 |
| 5,355,657 | A | * | 10/1994 | Chevalier et al. | 53/209 |
| 5,388,815 | A | * | 2/1995 | Hill et al. | 270/32 |
| 5,403,236 | A | * | 4/1995 | Greig | 462/6 |
| 5,409,105 | A | * | 4/1995 | Appelbaum et al. | 206/6.1 |
| 5,464,316 | A | * | 11/1995 | Kranz | 414/798.2 |
| 5,507,131 | A | * | 4/1996 | Schluger | 53/460 |
| 5,638,666 | A | * | 6/1997 | Davidov | 53/569 |
| 5,701,727 | A | * | 12/1997 | Lundstrom et al. | 53/569 |
| 5,775,494 | A | * | 7/1998 | Taplin | 206/308.2 |
| 5,817,353 | A | * | 10/1998 | Guarino | 426/124 |
| 5,860,589 | A | * | 1/1999 | Hsu | 229/162.3 |
| 5,950,399 | A | * | 9/1999 | Viens et al. | 53/381.6 |
| 6,070,719 | A | * | 6/2000 | Pollock | 206/232 |
| 6,155,031 | A | * | 12/2000 | Ballestrazzi et al. | 53/569 |
| 6,164,046 | A | * | 12/2000 | Werner et al. | 53/569 |
| 6,296,179 | B1 | * | 10/2001 | Wortman | 229/306 |
| 6,398,026 | B1 | * | 6/2002 | Parsons | 206/349 |
| 6,431,453 | B1 | * | 8/2002 | Hill et al. | 235/475 |
| 6,435,404 | B1 | * | 8/2002 | Feick | 229/303 |
| 6,446,375 | B1 | * | 9/2002 | Davis | 40/597 |
| 6,813,870 | B2 | * | 11/2004 | Iwamoto | 53/460 |
| 6,902,518 | B2 | * | 6/2005 | Bretl | 493/375 |
| 6,971,519 | B2 | * | 12/2005 | Fries | 206/454 |
| 7,048,182 | B2 | * | 5/2006 | Zettler | 235/380 |
| 7,104,034 | B2 | * | 9/2006 | Stemmle | 53/493 |
| 7,219,482 | B2 | * | 5/2007 | Stemmle | 53/429 |
| 7,228,292 | B2 | * | 6/2007 | Coyle | 705/39 |
| 7,581,723 | B2 | * | 9/2009 | Hascup | 270/1.03 |
| 7,634,895 | B2 | * | 12/2009 | Chan | 53/449 |
| 7,644,010 | B2 | * | 1/2010 | Haas et al. | 705/12 |
| 7,775,015 | B1 | * | 8/2010 | Crowley | 53/55 |
| 7,789,226 | B2 | * | 9/2010 | Carrigan et al. | 206/215 |
| D632,169 | S | * | 2/2011 | Ruth | D9/423 |
| 2002/0162757 | A1 | * | 11/2002 | Parsons | 206/232 |
| 2003/0009991 | A1 | * | 1/2003 | Iwamoto | 53/460 |
| 2004/0172922 | A1 | * | 9/2004 | Joyce et al. | 53/460 |
| 2005/0087978 | A1 | * | 4/2005 | Tucker | 283/105 |
| 2006/0218877 | A1 | * | 10/2006 | Brauneis et al. | 53/284.3 |
| 2006/0254216 | A1 | * | 11/2006 | Stemmle | 53/429 |
| 2007/0241034 | A1 | * | 10/2007 | Faissolle et al. | 209/2 |
| 2009/0240512 | A1 | * | 9/2009 | Prchal et al. | 705/1 |

OTHER PUBLICATIONS

U.S. Appl. No. 12/053,432, filed Mar. 21, 2008.

Chad Gracia, Actor Tips.com website, "Supercharge Your Headshot Mailings for More Auditions and More Acting Work," obtained at: http://www.actortips.com/products/headsho_envelopes.htm on Jul. 9, 2008, 7 pages (this reference is believed to be prior art with a publication date on or before Jan. 3, 2008).

Envelope Superstore.com: Serving Business since 1952 website; obtained at http://www.envelopesuperstore.com/Envelopes/Window-Envelopes.html?g=windowenvelopes on Jul. 9, 2008, 2 pages.

PCT International Search Report and Written Opinion mailed Sep. 28, 2009; International Application No. PCT/US2009/037567, 12 pages.

* cited by examiner

SYSTEM AND METHOD FOR CARD REPLACEMENT

CROSS-REFERENCES TO RELATED APPLICATIONS

This application claims the benefit under 35 U.S.C. 119(e) of provisional application 61/038,667, filed on Mar. 21, 2008, which is hereby incorporated by reference herein in its entirety for all purposes. This application is also related to application Ser. No. 12/053,421, filed Mar. 21, 2008, entitled "Emergency Card Replacement", and to application Ser. No. 12/053,432, filed Mar. 21, 2008, entitled "Replacement Card Packaging", which are hereby incorporated by reference herein in their entirety for all purposes.

BACKGROUND OF THE INVENTION

Credit cards, debit cards, and other kinds of presentation instruments have become a very popular means of making purchases. In a typical credit card transaction, a consumer presents the card at the time of a purchase. Account information is read from the card and the transaction details are transmitted to the card issuer, who has extended credit to the consumer. Upon approval, the purchase is completed, the issuer pays the merchant for the purchase, and the consumer is billed by the issuer for the purchase during the next regular billing cycle. A typical debit card transaction proceeds similarly at the point of sale, but payment is made from funds in an account associated with the debit card, rather than by the issuer. Both consumers and merchants benefit from the speed and convenience of transactions made with these kinds of presentation instruments.

Consumers also may find that such instruments are more secure than paying with cash. Many transactions require the person presenting the card to be authenticated as the rightful account holder, making it difficult for the card to be used fraudulently. Furthermore, the cardholder's liability for fraudulent charges may be limited by law. These kinds of presentation instruments are especially convenient for use when the cardholder is traveling. The cardholder need not risk carrying large amounts of cash, and currency conversions are handled automatically by the systems administering the accounts.

Because of these beneficial aspects, consumers may become dependent on their cards, especially when traveling. If a card is lost or stolen, the cardholder may be left without other means for making purchases. Even though the risk of liability for any fraudulent charges may be small, the inconvenience of a lost card may be enormous. Some card issuers recognize this problem, and provide emergency card replacements. Some advertise their card replacement speed and convenience as a way to differentiate their cards from those of other issuers.

There is accordingly a need to provide replacement presentation instruments quickly, accurately, and at low cost.

BRIEF SUMMARY OF THE INVENTION

In one embodiment, a system for assembling a shipping package, the system comprises a feeder feeding an envelope from a supply of envelopes, wherein the envelope contains a replacement presentation instrument and a shipping indicator. The shipping indicator comprises a shipping address visible through a first substantially clear window in the envelope. The system further comprises a transport mechanism that transports a shipping container from a supply of shipping containers and places the shipping container in position for the feeder to insert the envelope into the shipping container. Each shipping container comprises a second substantially clear window, and wherein when the envelope has been inserted into the shipping container, the shipping address is visible through the second substantially clear window. In some embodiments, the transport mechanism comprises an intermittently-moving feed belt.

In some embodiments, the transport mechanism is a first transport mechanism, and the system further comprises a second transport mechanism that receives the container from the first transport mechanism and passes the received container through a sealing mechanism. In some embodiments, the second transport mechanism comprises a continuously-moving feed belt. In some embodiments, the sealing mechanism comprises at least one guide that folds a flap on the shipping container towards a sealed position as the shipping container is transported by the second transport mechanism. In some embodiments, the shipping container is substantially flat and comprises a flap closure, the flap closure comprising adhesive covered by a liner, and the system further comprises a rotating brush that removes the liner as the shipping container is transported by either or both of the first and second transport mechanisms. In some embodiments, the system further comprises one or more vacuum cups that open the shipping container to accommodate insertion of the envelope. In some embodiments, the feeder is a stream feeder. In some embodiments, the shipping indicator further comprises a tracking indicium that is visible through the first substantially clear window.

In another embodiment, a method of assembling a shipping package comprises feeding an envelope from a supply of envelopes. The envelope contains a presentation instrument and a shipping indicator, and the shipping indicator comprises a shipping address visible through a first clear window in the envelope. The method further comprises transporting a shipping container from a supply of shipping containers, wherein the shipping container comprises a second clear window. The shipping container is positioned to receive the envelope fed from the supply of envelopes, and the envelope is inserted into the shipping container such that when the envelope has been inserted, the shipping address are visible through the second clear window. In some embodiments, the method further comprises sealing the shipping container. In some embodiments, the method further comprises automatically removing a liner, thereby exposing an adhesive on a flap of the shipping container. In some embodiments, the shipping indicator further comprises a tracking indicium that visible through the first and second clear windows when the envelope has been inserted into the shipping container. In some embodiments, the method further comprises holding the shipping container open using one or more vacuum cups, to accommodate insertion of the envelope.

DETAILED DESCRIPTION OF THE INVENTION

Most households in the United States now hold at least one credit card, and millions of new cards are issued annually. In order to meet this demand, highly-automated systems and processes have been developed for manufacturing and distributing new cards rapidly and in large quantities. New cards are typically distributed to consumers through first class mail or similar channels. This kind of mail often takes several days to reach its destination, and is often presented in pre-sorted high-volume mailings in order to reduce the cost to the sender.

Relatively few cards require emergency replacement, and it is not possible to predict which cards will need replacement. The mail channels used for new cards are therefore inappropriate for emergency replacement cards. Replacement cards are preferably shipped by overnight courier. Previous emergency replacement procedures have required significant manual processing, including the manual association of cards, card carriers, and shipping labels produced and printed separately. This extensive manual processing is expensive and prone to error.

Embodiments of the present invention provide automated systems and methods for providing emergency replacements for credit cards, debit cards, and other presentation instruments.

Figure 1:
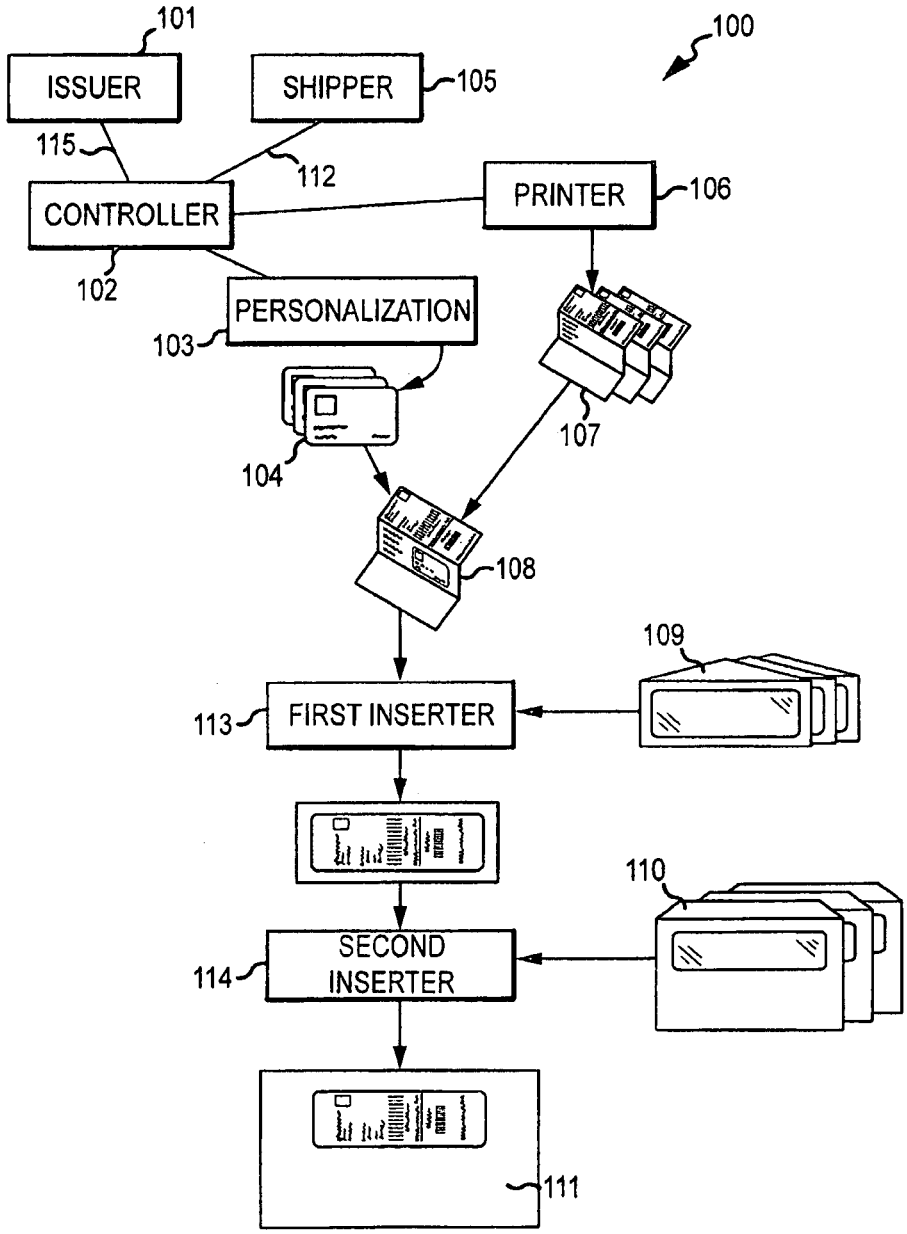
FIG. 1 illustrates a process and system for distributing a presentation instrument, in accordance with an example embodiment of the invention.

FIG. 1 illustrates a process 100 for distributing a presentation instrument, in accordance with an example embodiment of the invention. The illustrated process is especially suited to providing emergency replacement presentation instruments. For example, when a card or other presentation instrument is lost or stolen, the cardholder may call the issuer and speak to a customer service representative, who then arranges for the card replacement. The customer service representative may request information from the cardholder, such as the cardholder's name, a location to which to ship the replacement card, and other data. The information is entered into a computer system and a card replacement request initiated.

In the process of FIG. 1, a presentation instrument issuer 101 communicates over a communication link 115 to a controller 102 that a presentation instrument is to be produced and sent. Controller 102 may be, for example, a general-purpose computer system executing a program stored on a computer-readable medium. The computer may be, for example, a "System i" computer available from International Business Machines Corp., of Armonk, N.Y., USA, or may be another suitable computer system. While controller 102 is shown as a single block in FIG. 1, one of skill in the art will recognize that controller 102 may be a single computer or may comprise a plurality of interconnected computers, which may be co-located or widely separated. Process 100 may be performed by a single entity, for example issuer 101, or the various parts of the process may be performed by two or more different entities. For example, issuer 101 may outsource the production and distribution of presentation instruments to a processing organization that is a business entity separate from issuer 101. Alternatively, issuer 101 may outsource the entire process of issuing presentation instruments to the processing entity. Many other arrangements are also possible.

The communication from issuer 101 to controller 102 may include account and customer information to be used in producing and distributing the presentation instrument. For example, the communication may indicate the name of the customer to whom the presentation instrument will be issued, a shipping destination address to which the presentation instrument will be shipped, and an account number that will be assigned to the presentation instrument. Alternatively, controller 102 may have a pre-assigned list of account numbers to be used for presentation instruments distributed by process 100, in which case the communication from issuer 101 need not contain an account number.

Controller 102 sends the account information to a personalization machine 103, which produces a unique presentation instrument 104. Personalization refers to the process of making each presentation instrument unique by recording account information on the presentation instrument. In one example process, the presentation instruments are plastic cards, each comprising a magnetic strip on which information may be recorded magnetically. Until the cards are personalized, they do not contain any account or customer name information. During personalization of a card having a magnetic strip, the account number, customer name, expiration date, and other information may be recorded on the card by embossing the information onto the plastic card, and may also be recorded magnetically on the magnetic strip. During personalization of a smart card or a radio-frequency enabled payment device, account information may be recorded electronically in a memory on the presentation instrument. Personalization machine 103 may be, for example, a Maxsys, MX6000, or model 9000 machine available from Datacard Corporation, of Minnetonka, Minn., USA, or an other suitable personalization machine. After personalization, each card is uniquely identifiable and is associated with a particular account at the issuer of the card. In the example of FIG. 1, the presentation instrument produced is a card of this type, but one of skill in the art will recognize that other kinds of devices may be used as presentation instruments, and that the process may be used with may kinds of devices. For example, other kinds of devices that may be used as presentation instruments include chip-based cards, smart cards, and radio-frequency enabled devices such as key fobs, cards, watches, or other devices.

Controller 102 also communicates with a shipper 105 over a communication link 112. Shipper 105 may be, for example, a company that provides overnight courier service. Controller 102 may provide to shipper 105 information such as where a presentation instrument will be shipped from and the shipping destination. Shipper 105 may provide to controller 102 a tracking number and other identifying information for a particular package.

Controller 102 then communicates with a printer 106, which is configured to print a shipping indicator 107. Printer 106 may be, for example, a laser printer, an inkjet printer, or another kind of printer. In the example of FIG. 1, shipping indicator 107 is a tri-fold carrier made of paper, but other arrangements are possible. For example, shipping indicator 107 may simply be a card or other insert. Shipping indicator 107 comprises the information normally found on a shipping label. For example, shipping indicator 107 may comprise a shipping destination address and a tracking indicium such as a tracking number, bar code or other unique identifier for the eventual package in which presentation instrument 104 will be shipped. Shipping indicator 107 may also comprise account information relating to presentation instrument 104, of the kind often found on a carrier with which a presentation instrument is shipped or mailed. The set of accounting information printed on shipping indicator 107 may but need not be the same as the set of account information included on presentation instrument 104. For example, some information stored on presentation instrument 104 may be omitted from the set of account information printed on shipping indicator 107.

Figure 2:
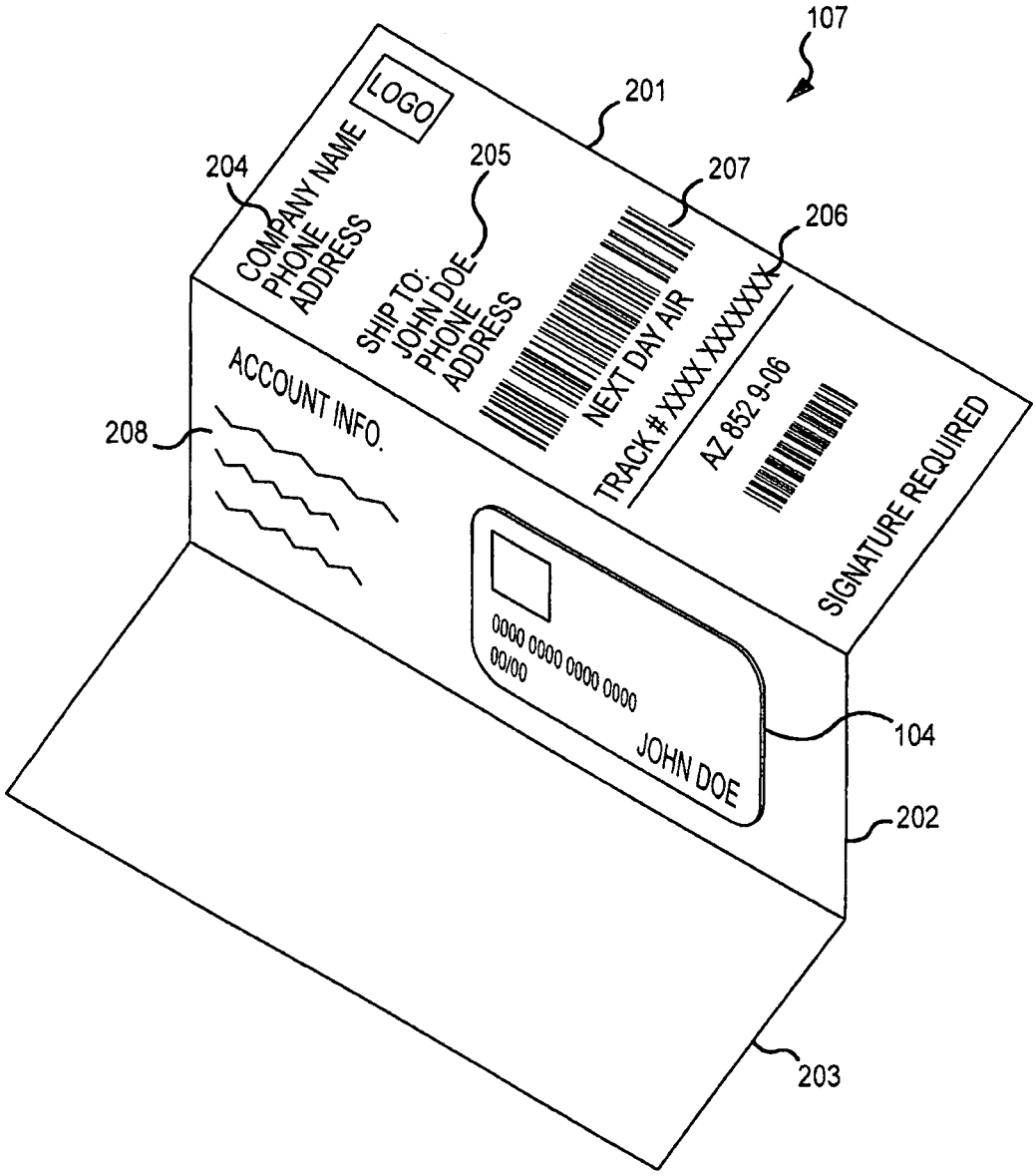
FIG. 2 shows a shipping indicator, in accordance with an example embodiment of the invention.

Preferably, but not necessarily, presentation instrument 104 is affixed to shipping indicator 107, forming a unit 108. For example, presentation instrument 104 may be attached to shipping indicator 107 using an adhesive that is secure yet leaves presentation instrument 104 readily removable from shipping indicator 107. Or corners of presentation instrument 104 may be tucked into cutouts or slots cut into shipping indicator 107. Preferably, personalization machine 103 and printer 106 are in close proximity, so that presentation instrument 104 and shipping indicator 107 can be associated with each other relatively early in the process, in order to avoid errors that may occur of presentation instrument 104 and shipping indicator 107 become separated from each other. A unit such as unit 108 contains all of the account and shipping information necessary to provide a replacement presentation instrument. A more detailed view of one example shipping indicator 107 is shown in FIG. 2.

Figure 3:
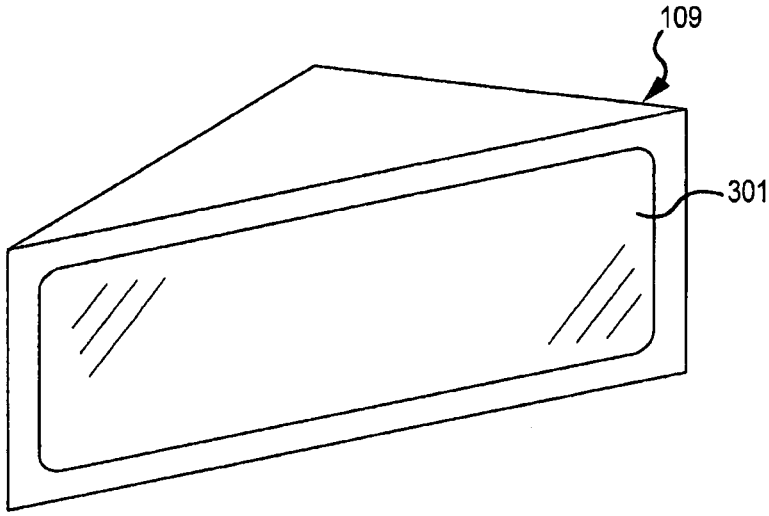
FIG. 3 shows an envelope comprising a clear window, in accordance with an example embodiment of the invention.

Presentation instrument 104 and shipping indicator 107 (which may be associated into a unit 108) are inserted, using a first automated inserter 113, into an envelope 109. Envelope 109 comprises a substantially clear window of sufficient size that the shipping information printed on shipping indicator 107 is visible when shipping indicator 107 and presentation instrument 104 are inserted into envelope 109. In one example embodiment, envelope 109 is a number ten envelope approximately 4.125 by 9.5 inches, and the clear window is approximately 3.125 by 8.5 inches, covering approximately 67 percent of the frontal area of envelope 109. Of course, other dimensions may be used, so long as the shipping information printed on shipping indicator 107 remains visible through the clear window. The clear window is preferably covered by a substantially clear plastic sheet adhered to the inside of envelope 109. A more detailed view of one example envelope 109 is shown in FIG. 3. Preferably, presentation instrument is hidden by shipping indicator 107, and is not visible through the substantially clear window after insertion into envelope 109.

Figure 4:
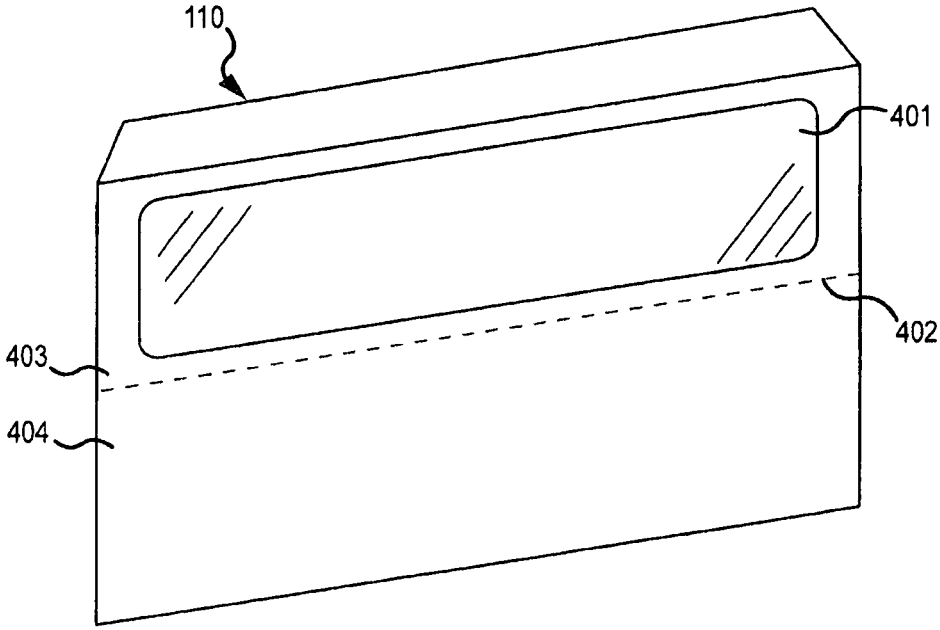
FIG. 4 shows a shipping container, in accordance with an example embodiment of the invention.

Envelope 109, containing shipping indicator 107 and presentation instrument 104, is then inserted, using a second automated inserter 114, into a shipping container 110, forming package 111. Shipping container 110 comprises a second substantially clear window of sufficient size that, when envelope 109 is inserted into container 110, the shipping information printed on shipping indicator 107 is visible through both the first clear window in envelope 109 and the second clear window in container 110. In some embodiments, a bead of adhesive is placed between the front and back faces of shipping container 110, dividing the interior of container 110 and constraining the movement of envelope 109 inside shipping container 110 so that clear windows in envelope 109 and container 110 remain aligned and the shipping information remains visible through both. The bead of adhesive may be continuous or may be interrupted, comprising a plurality of shorter beads or spots of adhesive. Other means may be used for constraining the movement of envelope 109 inside shipping container 110. For example, the front and back of shipping container 110 may be joined, either continuously or intermittently, along a line by stapling, sewing, heat welding, or by any other suitable means. A more detailed view of an example shipping container 110 is shown in FIG. 4.

Shipping container 110 may then be automatically sealed, and package 111 shipped to the shipping destination address using shipper 105. The process of FIG. 1 has several advantages over prior card replacement processes. The unique presentation instrument packaging, wherein the shipping information is printed on shipping indicator 107 and shows through the clear windows in envelope 109 and shipping container 110, avoids a separately-printed mailing label, and thus reduces the number of packaging steps and reduces the complexity of the replacement process. Shipping indicator 107 may be a component for which automatic insertion equipment is already available, and therefore the packaging arrangement enables automation of the card replacement process. Opportunities for errors are also reduced because fewer components must be associated into a card replacement package. Only presentation instrument 104 and shipping indicator 107 need to be particularly associated, and once they are properly associated, shipment of the correct card to the correct destination is assured. Because all of the shipping information is printed on shipping indicator 107 and no shipping information is printed or labeled on envelope 109 or shipping container 110, no particular envelope or shipping container need be selected or tracked.

FIG. 2 shows a more detailed view of a shipping indicator 107, in accordance with an example embodiment of the invention. In this example, shipping indicator 107 is a tri-fold carrier having a top section 201, middle section 202, and bottom section 203. In an unfolded state, shipping indicator 107 may be, for example, approximately 8.5 by 11 inches, although other sizes may be used. Top section 201 is printed with various information relating to the shipping of the eventual package in which shipping indicator 107 will be placed. For example, addresses 204 and 205 indicate the address from which the package is to be shipped, and the destination address respectively. In this example, top section 201 is also printed with one or more tracking indicia. In the example of FIG. 2, either or both of a tracking number 206 and a bar code 207 may be used for tracking purposes. Other information may be printed on top section 201 as well. Presentation instrument 104 has been attached to middle section 202. Various account information 208 may be printed on shipping indicator 107, for example on middle section 202, and information may be printed on bottom section 203 as needed or desired.

FIG. 3 shows a more detailed view of an envelope 109, in accordance with an example embodiment of the invention. In this example, envelope 109 is a number ten business envelope, approximately 4.125 by 9.5 inches and suitable for holding a standard 8.5 by 11 inch sheet folded in three sections. Any other suitable size envelope may be used. Envelope 109 comprises a front face having a substantially clear window 301. Clear window 301 may be formed by removing part of the opaque front section of envelope 109 and adhering a plastic, cellophane, or other substantially clear sheet to the inside of envelope 109 to cover the opening. Alternatively, window 301 may simply be an opening in envelope 109, without a covering sheet. In this example, clear window 301 extends to within about one half inch of each edge of envelope 109, leaving room for information printed on shipping indicator 107 to be visible when shipping indicator 107 is inserted into envelope 109.

FIG. 4 shows a more detailed view of a shipping container 110, in accordance with an example embodiment of the invention. Shipping container 110 is preferably a shipping envelope measuring approximately 9 by 12 inches, and made of cardboard, heavy paper, or another suitable material. Other sizes may be used as well. Shipping container 110 may be durable and semi-rigid, and of the kind commonly used for overnight or express shipment of documents. Shipping container 110 comprises a substantially clear window 401, formed in a manner similar to the way window 301 in envelope 109 is formed. A portion of the front of container 110 may be removed, and a substantially clear sheet adhered to the inside surface of container 110 covering the opening. Alternatively, window 401 may simply be an opening in shipping container 110, without a covering sheet. Preferably, window 401 in container 110 is at least as large as window 301 in envelope 109, and may be conveniently made somewhat larger. In some embodiments, a bead of adhesive 402 is placed between the front and back walls of container 110, so that the front and back are adhered together. This divides the interior of shipping container 110 into upper and lower sections 403 and 404 respectively. When envelope 109 is placed in upper section 403, adhesive 402 constrains the movement of envelope 109 such that window 301 in envelope 109, and consequently the shipping information printed on shipping indicator 107 and showing through window 301, remains showing through window 401.

While envelope 109 and container 110 may be specially made to comprise the aligning clear windows 301 and 401, they need not be printed or labeled in any way. All of the required information for shipping package 111 is printed on shipping indicator 107 and associated with presentation instrument 104 early in the process. No additional labels need be printed, associated with other items, or manually affixed to a shipping package. As such, the assembly of package 111 may be automated, and errors may be avoided.

Figure 5:
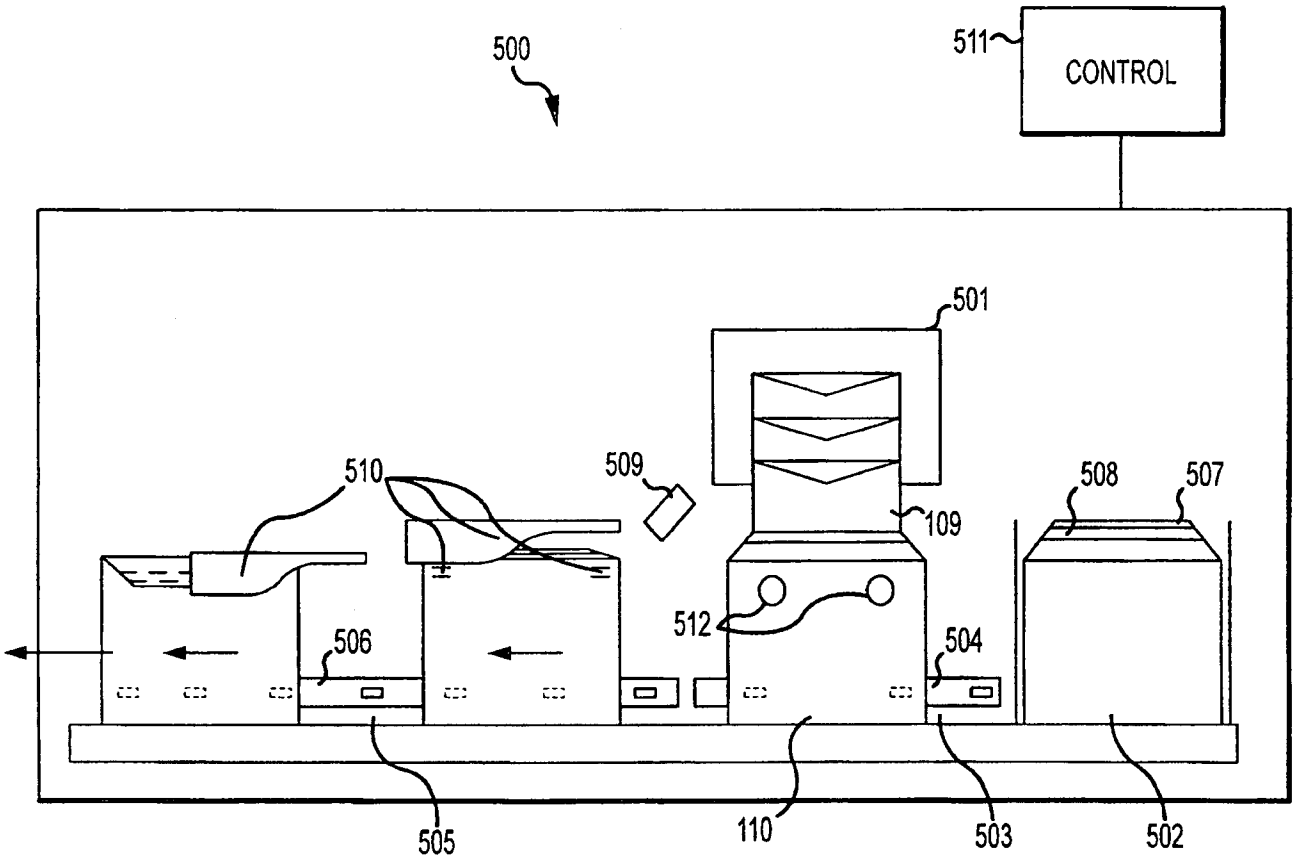
FIG. 5 depicts a top view of a system for assembling a shipping package, in accordance with an example embodiment of the invention.

FIG. 5 depicts a top view of a system 500 for assembling a shipping package, in accordance with an example embodiment of the invention. System 500 is preferably controlled by a control system 511, which may be a microprocessor system, computer, programmable logic controller, dedicated logic, or other suitable control system. Control system 511 synchronizes the various components of system 500, and may perform other functions such as error detection, counting, or other tasks.

In the example embodiment shown in FIG. 5, a feeder 501 feeds an envelope 109 from a supply of envelopes. The envelope contains a replacement presentation instrument and a shipping indicator. The shipping indicator comprises a shipping destination address visible through a first clear window in the envelope 109, and may also comprise a tracking indicium visible through the clear window. In FIG. 5, envelope 109 is positioned with the clear window downward, so that the window is not visible in the drawing. For the purposes of this disclosure, the shipping destination address and tracking indicium are considered to be visible through the first clear window even if the envelope 109 must be removed from system 500 in order for the window to be seen.

Feeder 501 may be one of a variety of envelope feeders known in the art, and in some embodiments may be a stream feeder. A stream feeder is one that moves sheets or envelopes in an overlapping flow, rather than moving them with space between.

System 500 also comprises a supply 502 of shipping containers, of which shipping container 110 is an example. Each shipping container comprises a second clear window. The shipping containers in FIG. 5 are positioned with their clear windows downward, so the clear windows are not visible in the drawing.

System 500 also comprises a first transport mechanism 503 that transports shipping containers from the supply 502 of shipping containers, and places each in position for the feeder to insert an envelope into it. Each envelope is inserted such that once the envelope is inside the shipping container, the shipping destination address and any tracking indicium are visible through the clear window in the shipping container. Preferably, first transport mechanism 503 comprises an intermittently-moving feed belt 504 that draws shipping containers from the supply 502 of containers. The motion of feed belt 504 may be started and stopped by a clutch and brake system. In some embodiments, a set of vacuum cups 512 operate to hold open shipping container 110 during insertion of envelope 109.

System 500 further comprises a second transport mechanism 505 that accepts the filled shipping containers from the first transport mechanism and passes each received container through a sealing mechanism. Preferably, second transport mechanism 505 comprises a continuously-moving feed belt 506. Once a shipping container has received an envelope, no further coordination with other feed streams is necessary, and the shipping container can be safely moved by a continuously-moving transport mechanism. In the example of FIG. 5, each shipping container, including shipping container 110, is a substantially flat shipping envelope, which may be made of heavy paper, cardboard, or another suitable material. Each example container comprises a flap 507, which may further comprise an adhesive covered by a liner 508. Liner 508 may be, for example, a glossy paper or plastic film designed to adhere only lightly to the pre-positioned adhesive, and to protect the adhesive from accidental contact with other items.

During transport of the shipping containers by one or both of first and second transport mechanisms 503 and 505, a rotating brush 509 may remove the liner from the adhesive of each container, in preparation for sealing of the container. In the example of FIG. 5, sealing is accomplished by a set of rollers and shaped guides 510 that fold each flap 507 over onto the main body of the container as the transport mechanisms drive the container through the rollers and shaped guides 510. After sealing, the filled shipping containers may be collected in an output hopper or bin, and then given to a representative of shipper 105 for shipping.

The invention has now been described in detail for the purposes of clarity and understanding. However, those skilled in the art will appreciate that certain changes and modifications may be practiced within the scope of the appended claims.

What is claimed is:

1. A method of assembling a shipping package, the method comprising:

feeding an envelope from a supply of envelopes, wherein:

the envelope contains a presentation instrument and a shipping indicator, the presentation instrument is physically distinct from the shipping indicator, the presentation instrument is coupled with the shipping indicator, and the shipping indicator comprises a shipping address visible through a first clear window in the envelope;

transporting a shipping container from a supply of shipping containers, wherein the shipping container comprises a second clear window;

positioning the shipping container to receive the envelope fed from the supply of envelopes; and inserting the envelope into a first compartment of the shipping container such that when the envelope has been inserted, the shipping address is visible through the second clear window, and the presentation instrument is not visible through the second clear window, and wherein:

the shipping container comprises a front-most wall, a back-most wall, and a bead of adhesive;

the bead of adhesive separates the first compartment of the shipping container from a second compartment of the shipping container;

the bead of adhesive couples the front-most wall directly to the back-most wall;

the second compartment is not accessible from an outside of the shipping container; and when the envelope has been inserted into the first compartment of the shipping container, the envelope is in contact with both the front-most wall and the back-most wall.

2. The method of claim 1, further comprising sealing the shipping container.

3. The method of claim 1, further comprising automatically removing a liner, thereby exposing an adhesive on a flap of the shipping container.

4. The method of claim 1, wherein the shipping indicator further comprises a tracking indicium that visible through the first and second clear windows when the envelope has been inserted into the shipping container.

5. The method of claim 1, further comprising holding the shipping container open using one or more vacuum cups, to accommodate insertion of the envelope.

6. The method of claim 1, wherein the envelope comprises a flap, and the method further comprises closing the flap over an opening of the envelope.

7. The method of claim 1, wherein the presentation instrument is not visible through the first window.

8. The method of claim 1, further comprising adhering the presentation instrument to the shipping indicator.

9. The method of claim 1, further comprising:

tri-folding the shipping indicator such that three panels on the shipping indicator are provided, wherein:

a first panel is separated from a second panel by a first crease;

the second panel is separated from a third panel by a second crease; and the shipping address is located on the first panel; and coupling the presentation instrument with the second panel.

10. The method of claim 9, wherein all information present on the first panel is visible through the first clear window.

11. The method of claim 9, wherein all information present on the first panel is visible through the second clear window.

12. The method of claim 9, wherein the second panel has account information located thereon related to the presentation instrument.

13. The method of claim 12, wherein the account information is not visible through the first clear window.

14. The method of claim 12, wherein the account information is not visible through the second clear window.

15. The method of claim 1, wherein the presentation instrument comprises a plastic card having a magnetic strip.

16. The method of claim 1, wherein the presentation instrument being coupled with the shipping indicator comprises the presentation instrument being adhered to the shipping indicator.

17. The method of claim 1, wherein the shipping container consists of the front-most wall, the back-most wall, the bead of adhesive, the second window, and a closure flap.

18. A method of assembling a shipping package, the method comprising:

feeding an envelope from a supply of envelopes, wherein:

the envelope contains a presentation instrument and a shipping indicator, the presentation instrument is physically distinct from the shipping indicator, the presentation instrument is coupled with the shipping indicator, and the shipping indicator comprises a shipping address visible through a first clear window in the envelope;

transporting a shipping container from a supply of shipping containers, wherein the shipping container comprises a second clear window;

positioning the shipping container to receive the envelope fed from the supply of envelopes; and inserting the envelope into the shipping container such that when the envelope has been inserted:

the shipping address is visible through the second clear window;

the presentation instrument is not visible through the second clear window; and the envelope is disposed in a first compartment of the shipping container, the first compartment being separated from a second compartment of the shipping container, wherein:

the shipping container comprises a front-most wall, a back-most wall, and a bead of adhesive;

the bead of adhesive separates the first compartment from the second compartment;

the bead of adhesive couples the front-most wall directly to the back-most wall;

the bead of adhesive runs from a left-most edge of the shipping container to a right-most edge of the shipping container;

the second compartment is not accessible from an outside of the shipping container;

the second compartment is not accessible from the first compartment; and when the envelope is disposed into the first compartment, the envelope is prevented from proceeding deeper into the shipping container by the bead of adhesive.

19. The method of claim 18, wherein the shipping container consists of the front-most wall, the back-most wall, the bead of adhesive, the second window, and a closure flap.

20. The method of claim 18, wherein:

the first compartment is in a top-most portion of the shipping container; and the second compartment is in a bottom-most portion of the shipping container.

21. The method of claim 18, wherein the second clear window is larger than the first clear window.

* * * * *